United States Patent [19]

Maynard

[11] 4,357,012

[45] Nov. 2, 1982

[54] GAME RACKET HAVING REMOVABLE STRINGED INSERT

[76] Inventor: Michael B. Maynard, 7040 S. Seven Oaks La., Canby, Oreg. 97013

[21] Appl. No.: 259,246

[22] Filed: Apr. 30, 1981

[51] Int. Cl.[3] ..... A63B 51/00

[52] U.S. Cl. ..... 273/73 L

[58] Field of Search ..... 273/73 R, 73 C, 73 D, 273/73 E, 73 L

[56] References Cited

U.S. PATENT DOCUMENTS

| | | | |
|---|---|---|---|
| 1,558,507 | 10/1925 | Ryder | 273/73 E |
| 2,034,444 | 3/1936 | Rauch et al. | 273/73 E |
| 3,814,423 | 6/1974 | Shockley et al. | 273/73 C |
| 3,891,211 | 6/1975 | Diefenbach | 273/73 L |
| 4,185,822 | 1/1980 | Li | 273/73 C |
| 4,206,917 | 6/1980 | Guillem et al. | 273/73 E |

FOREIGN PATENT DOCUMENTS

| | | | |
|---|---|---|---|
| 2831288 | 2/1980 | Fed. Rep. of Germany | 273/73 D |
| 2373302 | 8/1978 | France | 273/73 L |

*Primary Examiner*—Anton O. Oechsle

*Attorney, Agent, or Firm*—Chernoff & Vilhauer

[57] ABSTRACT

A sports racket such as a tennis racket has a head comprising a pair of concentric frames wherein an inner frame equipped with tensioned strings is supported resiliently within an outer frame by an inflated tube lying within opposing parallel channels extending respectively about the periphery of the inner frame and along the interior of the outer frame. Variation of the pressure of inflation of the tube controls the elasticity of the support of the inner frame, and deflation of the tube permits rapid removal and replacement of the inner frame.

12 Claims, 5 Drawing Figures

GAME RACKET HAVING REMOVABLE STRINGED INSERT

BACKGROUND OF THE INVENTION

The present invention relates to game rackets, and particularly to a racket having a removable stringed inner frame insert.

The construction of rackets for games, particularly tennis rackets, has improved considerably in recent years, with lightweight but very strong materials being used in the construction of racket frames. Tennis rackets are built to be stiffer and are strung more tightly, in order to permit players to impart greater speed to the tennis ball and at the same time control its direction and the amount and direction of spin imparted to the ball. While this tighter stringing permits the desired control and speed to be obtained, one disadvantage is that the shock of impact between the ball and the strings of the racket is generally transmitted through the racket's head and handle to the player's hand and arm. Depending on the material used in the frame and handle of the racket, varying amounts of vibration are transmitted similarly to the player's arm. Such transmission of shock and vibration to the player's hand and arm may be tiring to the player, and may additionally contribute to the injury of the player's wrist, arm, or elbow.

Tennis rackets, particularly when tightly strung, are subject to occasional failure of the strings. Over a period of use the stringing of a racket ordinarily loses some of its tension. In the past, these conditions have required the racket to be restrung. This procedure takes a considerable amount of time and is beyond the skill of most racket users. As a result, restringing usually results in loss of use of the racket for at least a day or more.

Different conditions may make it desirable to use rackets strung with a different amount of string tension. For example, a difference in air temperature may result in a change in the tension in the racket strings. It may therefore be desirable to have rackets strung at different tensions at a given air temperature, in order to have a desired tension at the ambient air temperature where the racket will be used. Different playing surfaces may make it desirable to have more or less tension in the strings of the racket in order to take greater advantage of the ability of the ball to be spun off the playing court surface, or the need to deliver the ball with a great deal of speed where a playing court surface does not permit as effective use of spin.

These problems have been approached previously in several different ways. For example, Shockley, et al, U.S. Pat. No. 3,814,423 discloses a racket having parallel metal frames located on opposite sides of a resilient plastic member which supports the strings of the racket.

Guillem, et al, U.S. Pat. No. 4,206,917 discloses a racket in which the strings are held in tension by passing over a liquid-containing flexible tube in the frame of the racket.

Ryder U.S. Pat. No. 1,558,507 discloses a racket whose head frame may consist of little more than an inflated tube.

Small helical springs have also been embedded in the frames of rackets to provide tension in the racket strings. While these inventions provide for some resiliency in the support of the strings of the racket, when the strings of such rackets break the rackets must still be restrung as in the past.

Li, U.S. Pat. No. 4,185,822 provides a racket having a separate inner frame which holds the pretensioned strings within an outer frame, permitting the inner frame to be replaced by flexibly opening the outer frame. The inner frame of one embodiment of the Li racket is suspended between a pair of pneumatic tubes, but similarly is removable only by flexing open the outer frame of the racket's head.

In another recently developed tennis racket, an outer frame includes a hinge permitting the outer frame to be opened to allow replacement of a stringed inner frame. However, the hinge and outer frame closure of such a racket provide undesirable potential stress concentrations within the outer frame of such a racket, which may cause undesirable flexure patterns in the racket frame or lead to early failure of such an outer frame.

What is needed, then, is an improved sports racket which may be tightly strung yet transmit an acceptably small amount of shock and vibration to the user's arm. Preferably such a racket could be quickly provided with strings having the optimum tension for the playing conditions and could be quickly adjusted to provide a desired amount of stiffness or softness of action of the racket frame.

SUMMARY OF THE INVENTION

The present invention overcomes the above-mentioned shortcomings and disadvantages of previously known sports rackets by providing a racket which utilizes a flexible tube filled with a compressible fluid to absorb shock and to retain a string-supporting quickly removable inner frame in the proper location within an outer frame, isolating the outer frame and handle of the racket from some of the shock of a ball meeting the striking surface of the racket and reducing the amount of vibration transmitted through the racket to the user's arm and elbow.

A racket embodying the present invention includes an outer frame, which may be of wood, but is preferably constructed of another material having a greater ratio of strength to weight, such as steel, aluminum, titanium, or a graphite composition. The outer frame of the racket embodying the present invention may have the same general configuration as that of a conventional racket for the same sport, but the outer frame does not directly support strings. Instead, an inner frame having a shape similar to that of the outer frame supports strings, which may be arranged and supported under a predetermined amount of tension in the manner common in conventional sports rackets. The size of the inner frame permits it to move only slightly with respect to the outer frame in a direction parallel to the plane of the outer frame, but permits the inner frame to move freely into or out of alignment with the outer frame, in a direction perpendicular to the plane of the racket.

Circumscribing the exterior surface of the inner frame and extending along an interior surface of the outer frame are opposed corresponding channels, which are preferably approximately semi-circular to profile. Located within the channels is a flexible tube, exemplarily of circular cross-section, which fits closely within the channels extending around the interior of the outer frame and exterior of the inner frame. The flexible tube is ordinarily inflated with a compressible fluid such as air, thus holding the inner and outer frames aligned with one another.

Depending on the amount of pressure within the flexible tube, it limits the relative motion between the inner and outer frames, while the compression and reexpansion of the fluid within the tube reduces the amount of shock transmitted to the hand and arm of the user of the racket. Variation of the pressure also controls to some extent the stiffness and speed of response of the racket as a whole. When the flexible tube is deflated, the inner frame insert may be removed from its usual location within the outer frame, permitting exchange of inner frame inserts to rapidly replace broken strings or provide a different string tension.

It is therefore a primary objective of the present invention to provide an improved sports racket having a stringed inner frame insert suspended within an outer frame by means of a resilient inflated tube.

It is another important objective of the present invention to provide a sports racket in which reduced amounts of shock and vibration are transmitted by the racket to the hand and arm of the user.

It is a further objective of the present invention to provide a racket which is unlikely to cause injury to the hand and arm of the user.

It is a principal feature of the sports racket of the present invention that it includes a rigid outer frame which supports a quickly replaceable inner frame insert.

It is another feature of the racket of the present invention that it may be adjusted to provide different amounts of vibration damping and stiffness of racket response.

It is a principal advantage of the present invention that it provides a sports racket which transmits less vibration to the arm and hand of the user than previously known rackets with the same string tension.

It is another advantage of the present invention that it provides a racket which transmits a smaller amount of the shock of impact of an object against the racket strings to the arm and hand of the user than is the case with conventional rackets.

It is a further advantage of the present invention that it provides a racket which may be made ready for use after breakage of the strings much more quickly than previously known rackets.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
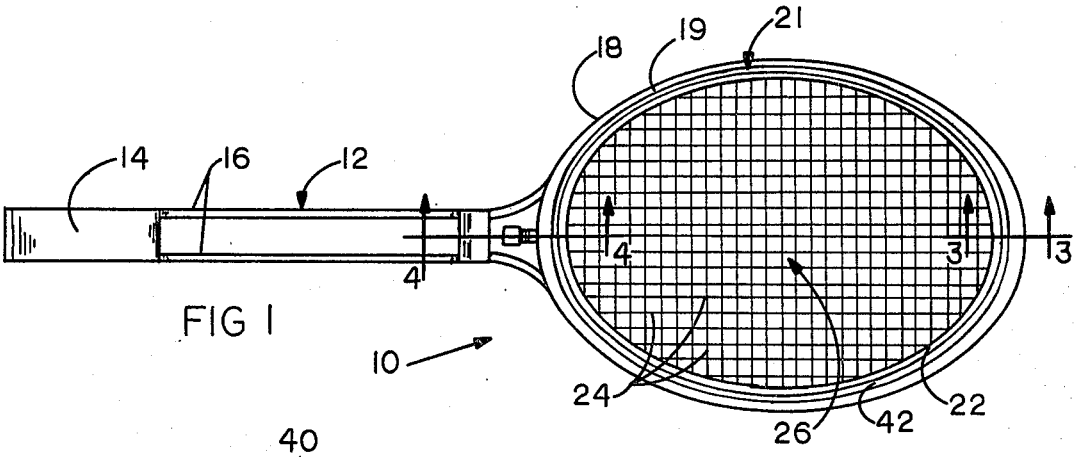
FIG. 1 is a plan view of an exemplary tennis racket embodying the present invention.

Referring now to the drawings, FIG. 1 shows an exemplary tennis racket 10 embodying the present invention. The tennis racket 10 includes a handle portion 12 having a grip 14, a shaft 16, and a head portion 18. The head portion 18 of the racket 10 is generally planar and includes an outer frame 19 which has an interior side 20 and defines an opening 21 surrounded by the outer frame. An inner frame 22 is of similar shape to the outer frame 19 and fits within the outer frame 19 in a generally co-planar relationship thereto. Strings 24, which may be of conventional type and material, are mounted under tension on the inner frame 22, extending across the opening defined by the inner frame 22, forming a generally planar striking zone 26.

Figure 4:
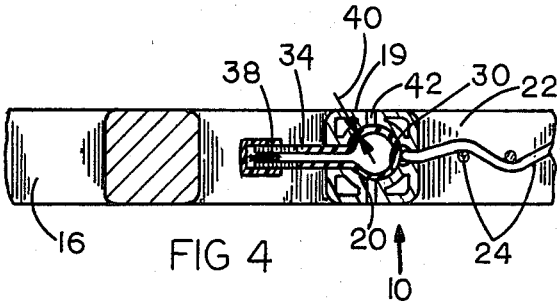
FIG. 4 is a sectional view, at an enlarged scale, of a portion of the tennis racket shown in FIG. 1, taken along line 4—4.
Figure 3:
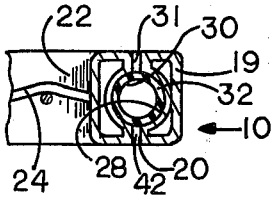
FIG. 3 is a sectional view, at an enlarged scale, of a portion of the head of the tennis racket shown in FIG. 1, taken along line 3—3.
Figure 2:
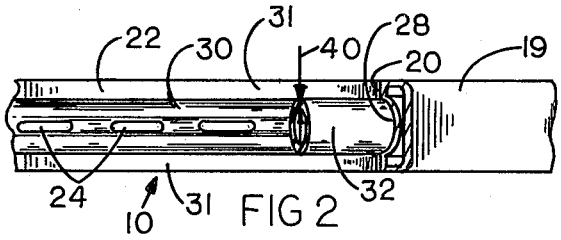
FIG. 2 is a fragmentary, partially cut-away side elevational view, at an enlarged scale, of the head of the tennis racket shown in FIG. 1.
Figure 5:
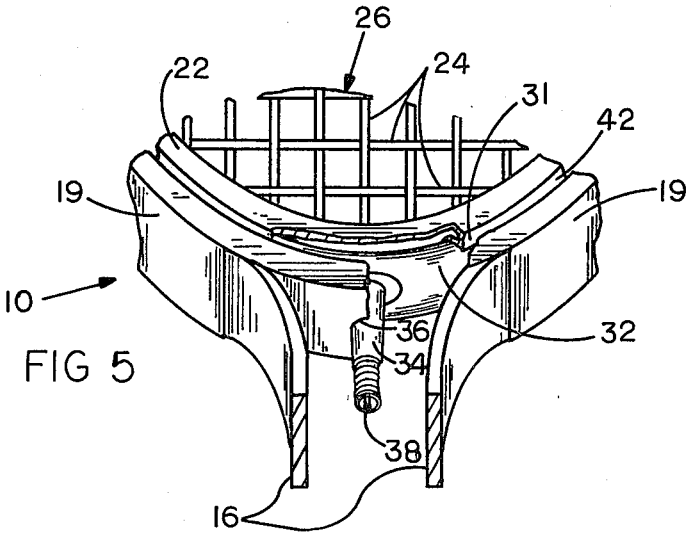
FIG. 5 is a partially cut-away pictorial view, at an enlarged scale, of a detail of the tennis racket shown in FIG. 1.

Referring now also to FIGS. 2–4, it may be seen that the interior side 20 of the outer frame 19 defines a first channel 28 of generally semi-circular profile, which extends along the entire interior side 20. The inner frame 22 defines a second channel 30 which is located opposite the first channel 28 and has a similar shape and size. The second channel 30 extends circumferentially around the exterior side 31 of the inner frame 22.

Located within the first and second channels, and thus between the inner frame 22 and outer frame 19, is a hollow tube 32. The tube 32 is generally toroidal in shape, except for an inflation neck 34 which extends generally radially outward through a hole 36 defined in a throat portion 37 in the outer frame 19, permitting the inflation neck 34 to extend within the shaft 16. Depending upon the material of which the racket 10 is constructed, the inflation neck 34 will be exposed between parallel portions of the shaft 16, or an opening to receive the neck 34 may be provided in a solid shaft 16. Preferably, the inflation neck 34 is equipped with a valve 38 permitting the tube 32 to be inflated to a desired pressure and permitting air to be released from the tube 32 as desired.

The tube 32 is preferably of flexibly reinforced rubber or similar construction and has a relatively thin wall whose thickness 40 permits the tube 32 to collapse within one of the channels 28 or 30 when deflated, thus permitting the inner frame 22 to be removed from its position parallel and co-planar with the plane defined generally by the outer frame 19.

Preferably, the exterior dimensions of the inner frame 22 will be slightly smaller than the corresponding dimensions across the interior of the outer frame 19, providing a small amount of clearance space 42 between the inner frame 22 and outer frame 19. This clearance space 42 permits a predetermined small distance of relative motion between the outer frame 19 and inner frame 22, in any direction parallel to the general plane of the head 18. The amount of relative motion is primarily controlled by the flexibility and compressibility of the inflated tube 32 as well as the size of the space 42.

When the player using the racket 10 strikes a ball some of the energy of the ball and racket is stored temporarily in compression of the tube 32 and the gas contained therein, as well as in the elastic deformation of the ball and of the strings 24. As the ball is accelerated, the resilient rebound of the tube 32 forces the inner frame 22 in the direction opposite that toward which it was deformed, returning the stored energy to the ball.

The compressibility of the inflated tube 32 depends partly on the material and thickness of the tube wall 40, and to a great extent upon the inflation pressure. Thus with a high pressure of inflation the response of the racket 10 will be similar to that of a stiff, solid-frame tennis racket, while with a lower pressure of inflation the response of the racket will be somewhat softer and more resilient, with less of the shock and vibration caused by the impact of a ball against the striking zone 26 being transmitted from the strings 24 to the hand and arm of the racket user.

If the strings 24 of the racket 10 become too loose or break during use of the racket, the inner frame 22 may be removed from within the outer frame 19 by opening the valve 38 and deflating the tube 32. Deflation permits the tube 32 to collapse within one of the channels 28 or 30. The inner frame 22 can then be removed and replaced by a similar, satisfactorily strung, inner frame 22 in a very brief time. Thereafter it is only necessary to reinflate the tube 32 to the desired pressure to provide the desired amount of support of the inner frame 22 to make the racket ready for use.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A sports racket, comprising:

(a) a handle;

(b) an outer frame fixedly attached to said handle;

(c) a stringed inner frame whose exterior shape corresponds to the interior shape of said outer frame; and (d) inflatable means extending around said inner frame and within said outer frame, for supporting and retaining said inner frame within said outer frame when said inflatable means is inflated and permitting removal of said inner frame from within said outer frame when said inflatable means is deflated.

2. A sports racket, comprising:

(a) a handle;

(b) a unitary outer frame fixedly connected to said handle, said outer frame defining an interior opening and including a first channel extending along the interior side thereof, said first channel being open toward said interior opening;

(c) an inner frame no larger than said interior opening defining a striking zone surrounded thereby, said inner frame defining a second channel extending circumferentially along the exterior side thereof, said inner frame being located within said outer frame and being generally co-planar therewith; and (d) an inflatable resiliently flexible tube extending around said inner frame, respective portions thereof being located within said first and second channels, said flexible tube supporting said inner frame removably in a predetermined location within said outer frame.

3. The racket of claim 2 wherein said inner frame includes means for supporting strings under tension extending through said striking zone.

4. The racket of claim 3 including strings extending through said striking zone, supported under tension by said inner frame.

5. The racket of claim 2 wherein each of said first and second channels is of substantially uniform depth.

6. The racket of claim 5 wherein said first and second channels have substantially equal widths and have similar profiles.

7. The racket of claim 2 wherein said tube is made of a reinforced rubber-like material.

8. The racket of claim 2, said tube including an inflation neck and valve means located therein for controllably inflating said tube, said neck and valve means extending within said handle of said racket.

9. The racket of claim 2 wherein said head is generally planar and said exterior side of said inner frame corresponds in general shape to the shape of said interior side of said outer frame, said inner frame fitting within said outer frame in generally co-planar relationship thereto, providing room for said inner frame to move a predetermined distance relative to said outer frame, in any direction parallel to the plane of said racket head.

10. The racket of claim 9 wherein said tube has a diameter which is greater than said predetermined distance of relative motion between said inner and outer frames, and a wall thickness which is less than said predetermined distance.

11. A sports racket, comprising:

(a) a handle;

(b) an outer frame connected to said handle;

(c) an inner frame removably located within an interior opening defined by said outer frame, said inner frame defining a striking zone and including means for independently supporting strings extending through said striking zone under tension;

(d) means for defining a first channel extending around the interior of said outer frame;

(e) means for defining a second channel extending around the exterior of said inner frame; and (f) inflatable means disposed around the periphery of said inner frame and including portions thereof extending within both of said first and second channels, for removably holding said inner frame in a predetermined location with respect to said outer frame and permitting a predetermined amount of relative motion of said inner frame with respect to said outer frame.

12. The racket of claim 11, including strings extending through said striking zone, supported under tension by said inner frame.

* * * * *